US009874181B2

(12) United States Patent
Odillard et al.

(10) Patent No.: US 9,874,181 B2
(45) Date of Patent: Jan. 23, 2018

(54) DEVICE FOR ADMITTING INLET GASES AND/OR RECIRCULATED EXHAUST GASES INTO AN INTERNAL COMBUSTION ENGINE CYLINDER

(71) Applicant: VALEO SYSTEMES THERMIQUES, Le Mesnil Saint Denis (FR)

(72) Inventors: Laurent Odillard, Le Luart (FR); Julio Guerra, Itteville (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 0 days.

(21) Appl. No.: 14/904,544

(22) PCT Filed: Jul. 9, 2014

(86) PCT No.: PCT/EP2014/064708
§ 371 (c)(1),
(2) Date: Jan. 12, 2016

(87) PCT Pub. No.: WO2015/010903
PCT Pub. Date: Jan. 29, 2015

(65) Prior Publication Data

US 2016/0146164 A1 May 26, 2016

(30) Foreign Application Priority Data

Jul. 26, 2013 (FR) ..... 13 57405

(51) Int. Cl.

| | |
|---|---|
| ***F02M 26/21*** | (2016.01) |
| ***F02M 26/64*** | (2016.01) |
| ***F02M 35/10*** | (2006.01) |
| ***F02D 17/02*** | (2006.01) |
| ***F02M 26/20*** | (2016.01) |

(Continued)

(52) U.S. Cl.
CPC ..... *F02M 26/64* (2016.02); *F02D 9/02* (2013.01); *F02D 17/02* (2013.01); *F02M 26/20* (2016.02); *F02M 26/71* (2016.02); *F02M 35/10222* (2013.01); *F02M 35/10255* (2013.01); *F02B 29/0475* (2013.01); *F02D 2009/0276* (2013.01);

(Continued)

(58) Field of Classification Search
CPC ..... F02M 26/21; F02M 26/20; F02M 26/52; F02M 26/70
USPC ..... 123/568.18
See application file for complete search history.

(56) References Cited

FOREIGN PATENT DOCUMENTS

| | | |
|---|---|---|
| DE | 19633603 | 11/1997 |
| FR | 2833650 | 6/2003 |

(Continued)

*Primary Examiner* — Jacob Amick
*Assistant Examiner* — Charles Brauch
(74) *Attorney, Agent, or Firm* — Duane Morris LLP; J. Rodman Steele, Jr.; Gregory M. Lefkowitz

(57) ABSTRACT

The invention relates to a device for admitting inlet gases and/or recirculated exhaust gases into an internal combustion engine cylinder, the device comprising a duct designed to supply said cylinder with inlet gases and/or with recirculated exhaust gases, characterized in that said device further comprises, in the duct, a flow control means that can be operated between a first position in which said duct supplies the cylinder with the inlet gases and a second position in which said duct supplies the cylinder with the recirculated exhaust gases. It also relates to the intake module and to the engine equipped therewith.

20 Claims, 3 Drawing Sheets

(51) Int. Cl.

| | |
|---|---|
| ***F02M 26/71*** | (2016.01) |
| *F02M 26/52* | (2016.01) |
| *F02B 29/04* | (2006.01) |
| *F02D 9/02* | (2006.01) |
| *F02M 26/70* | (2016.01) |

(52) U.S. Cl.
CPC ..... *F02M 26/21* (2016.02); *F02M 26/52* (2016.02); *F02M 26/70* (2016.02)

(56) References Cited

FOREIGN PATENT DOCUMENTS

| | | | | |
|---|---|---|---|---|
| JP | S5683543 | | | 7/1981 |
| JP | S5683543 | A | * | 7/1981 |
| JP | S57181945 | | | 11/1982 |

* cited by examiner

DEVICE FOR ADMITTING INLET GASES AND/OR RECIRCULATED EXHAUST GASES INTO AN INTERNAL COMBUSTION ENGINE CYLINDER

CROSS-REFERENCE TO RELATED APPLICATIONS

This application is a §371 national stage entry of International Application No. PCT/EP2014/064708, filed Jul. 9, 2014, which claims priority to French Patent Application No. 1357405 filed Jul. 26, 2013, the entire contents of which are incorporated herein by reference.

The present invention applies to the field of supplying internal combustion engines with air. It is more particularly directed to multi-cylinder engines and to devices used for controlling the admission gas and exhaust gas flows re-circulated towards the cylinders.

The engines concerned by the invention may be with controlled ignition or ignition by compression (diesel engine) and, they may be supercharged or charged at atmospheric pressure. In the following, by charged or supercharged air will be meant fresh air, optionally mixed with exhaust gases recovered at the engine outlet, according to a method generally known under the acronym of EGR ("Exhaust Gas Recirculation"). Moreover, the term of exhaust gas will be specifically used for referring to the gases from the combustion process between the fuel and the air supply in the engine, before any mixing.

Usually, an engine operates with a totality of its cylinders according to a known cycle (Admission—Compression—Combustion/expansion—Exhaust). This cycle is characterized by its yield, which is recognized as being optimum when the losses due to the transfilling of the gases, also called losses by pumping, during the admission and exhaust phases are a minimum. In order to limit these losses, deactivating one or several cylinders during operation with a small load has already been proposed or, more generally when the required power may be ensured by only one portion of the cylinders of the engine.

In order not to reintroduce fresh gas into the exhaust, which would prevent treatment of the exhaust gases at the outlet of the engine, deactivation is accomplished by directly acting on the opening of the valves of the relevant cylinders, either by making them totally inactive or by controlling them differently. Such a device complexifies the distribution system and causes significant increases in costs as well as in reliability risks.

Moreover, the fact of not feeding the cylinder has drawbacks. The temperature in the deactivated cylinder significantly decreases, which causes a decrease in the overall temperature of the exhaust gases, notably upon restarting the cylinder. Even without any passage of fresh air, this temperature decrease is detrimental to the catalyst of the chain for treating the exhaust gases. Further, as the pressure is too low above the piston while it continues to move, the oil may escape more substantially than under normal conditions towards the combustion chamber between the piston and the liner. This leak, also called a blow-by flow, has harmful consequences on the operation of the engine if it is too significant.

In order to find a remedy to these drawbacks, feeding the deactivated cylinder with exhaust gas recovered at the outlet of the engine has been already proposed. Notably, as these gases are hot and may be transferred at a high pressure, this gives the possibility of maintaining the pressure and the temperature in the deactivated cylinder. The solution, shown in WO 2006/032886, partitions the intake manifold for this purpose.

The device shown in the aforementioned document poses difficulties for application. First of all, the good yield of the engine notably depends on an adequate gas supply for each cylinder. Introducing a partition in the manifold perturbs the distribution of the supply flows of the cylinders. Further, if the intention is to select the number of cylinders to deactivate depending on the operating conditions of the engine, this causes significant complexification in the design of the partitioning in order to adapt to the different cases.

Further, in certain applications, the intake manifold integrates a heat exchanger for cooling the intake gases, with view to increasing its density. Taking into account this integration and the size constraints, the space left free in the manifold is then insufficient for making a partitioning therein which properly supplies the cylinders.

The purpose of the present invention is to give the possibility of applying on an existing engine, deactivation of a cylinder by feeding it with exhaust gases in a reliable, flexible way as to the control of the cylinders, and without requiring reconsideration of the design of the intake system.

DESCRIPTION OF THE INVENTION

The invention relates to a device for introducing, in a cylinder of an internal combustion engine, admission gases and/or re-circulated exhaust gases, including a conduit laid out for supplying said cylinder with admission gases and/or re-circulated exhaust gases, characterized in that said device further comprises in the conduit, a flow control means controllable between a first position in which said conduit feeds the cylinder with admission gases and a second position in which said conduit feeds the cylinder with re-circulated exhaust gases.

In other words, said device is configured for feeding one and only one cylinder and said control means controls the flows of admission gases and/or re-circulated exhaust gases in the conduit(s) feeding said cylinder, exclusively, while being positioned for this in said conduit(s). Partitioning of the intake manifold is thus avoided inevitably creating a pressure drop when the engine is not in a mode for deactivating the cylinders. This further allows more fine control of the admission of the gases into the cylinders, by not modifying or very little the design of the intake manifold.

Moreover, it should be noted that, in said first position, the control means blocks the passing of the re-circulated exhaust gases and in said second position, the control means blocks the passing of the admission gases.

Preferably, in the device, the conduit includes an opening for receiving the exhaust gases made in one of its walls.

Advantageously, the flow control means uses a gate rotating inside the conduit around an axis transverse to this conduit. Said gate may include a transverse portion, said transverse portion being intended to define said first and said second positions of said flow control means, depending on the angular position of said gate.

In other words, said transverse portion leaves an opening in the conduit when the gate is in the first position and blocks the section of the conduit when the gate is in the second position. Such a gate system may easily be integrated inside a conduit. Further, it has advantages as compared with other systems, such as flaps for example.

A first advantage of the gate is that it gives the possibility of achieving control of the exhaust gas flow at the same time as that of the admission gases.

More specifically, at least one wall of the admission conduit may have a boss configured for housing at least one fraction of the transverse portion of the rotating gate when it is found in said first position. Advantageously, the opening for receiving the exhaust gases in said conduit may be made in said boss and an external face of the transverse portion of the rotating gate is configured so as to be in contact with an internal wall of said boss around said opening for the exhaust gases, when the gate is in said first position.

A second advantage is that the gate may be integrated into the wall, not forming any obstacle in the gas flow conduit.

Thus, preferably, the transverse portion of the rotating gate includes an internal face, turned towards the inside of the conduit, configured so as to form a portion of an internal surface of the wall of the conduit when the gate is in said first position, where it lets through the admission gases. Advantageously, the internal face of the transverse portion of the rotating gate is configured so as to be connected to the internal surface of the wall surrounding the conduit with shape continuity when the gate is in said first position.

Also advantageously, said internal face of the transverse portion of the gate is configured in order to form a deflector of exhaust gases when the gate is in said second position.

More specifically, notably when the opening for receiving the re-circulated exhaust gases is in the boss of the gate, said internal face forms a tilted surface facing said opening which directs the gases in the main direction of the conduit by going towards the outlet intended for feeding the cylinder of the engine, when the gate is in said second position. In this way, the gate participates in facilitating the flow and in minimizing the pressure drops by deflecting the exhaust gas flow towards the cylinder.

In a particular embodiment, the flow control means is substantially placed at the mouth of the conduit opposite to the one intended for feeding the cylinder. This location generally corresponds to the mouth of the conduit in the manifold and is sufficiently cleared so as to install the device therein in a supply module.

Advantageously, said device further includes a controllable obturation means for this arrival of exhaust gases, able to hermetically close said arrival of exhaust gases. Indeed, it is preferable that there be no leak of exhaust gases, which leave the engine at a higher pressure than the admission gases, in the flow feeding the cylinder when it is not deactivated. This would be detrimental to the yield of the engine, the mixture of the admission gases for an operating condition of the engine being metered upstream from the manifold.

For example it may be difficult to produce a gate which hermetically closes the arrival of the exhaust gases in the conduit for feeding the cylinder of the engine. It may therefore be of interest to complete the device by installing for example a valve or a flap. Advantageously, the seat of the valve is formed by a portion of said conduit.

The device is advantageously completed by adding thereto means for controlling the flow control means in the conduit and means for controlling the hermetic obturation means for the arrival of re-circulated exhaust gases. They may in particular be capable of opening said obturation means when said flow control means is in its second position and of closing said obturation means when said flow control means passes into its first position.

These control means include mechanisms capable of switching the flow control means and the obturation means from one position to another. In this way, a system for controlling the engine which activates or deactivates the relevant cylinder may accordingly control the device according to the invention.

Advantageously, the means for controlling the flow control means and the control means for the obturation means form a single actuator.

The invention also relates to an air intake module for an internal combustion engine including at least one device as described, with or without its control means.

The air admission module generally installed above the cylinder head of an internal combustion engine includes a portion making the interface between the manifold and the cylinder head of small height. Therefore it is on a conduit with a very short length relatively to the width of its section which the flow control device has to be integrated, which explains why it would have seemed more natural to install it at the manifold, as described in the aforementioned document. The invention however provides such integration, in particular in the case of a gate. Said module may comprise a heat exchange bundle.

The invention further relates to an internal combustion engine including at least one cylinder, a system for deactivating said cylinder(s) and at least one device as described earlier, said device being laid out for feeding said cylinder and being controlled by the deactivation system.

Advantageously, on such an engine including at least two cylinders, a system for deactivating at least two of said cylinders, said deactivatable cylinders, and at least two devices as described earlier, each of said devices is laid out so as to feed one of said deactivatable cylinders and be controlled independently by said deactivation system.

DETAILED DESCRIPTION OF THE INVENTION

The present invention will be better understood and other details, features and advantages of the present invention will become more clearly apparent upon reading the description which follows, with reference to the appended drawings wherein:

FIG. 1 shows a sectional perspective view of an air admission module of an exemplary embodiment of the device according to the invention in a first position of its flow control means.

FIG. 2 repeats FIG. 1 in a second position of the flow control means.

FIG. 3 schematically shows the operating mode of the device according to the invention in the position letting through admission gases into the conduit equipped with said device and blocking the arrival of exhaust gases.

FIG. 4 schematically shows the operating mode of the device according to the invention in the position blocking the admission gases in the conduit equipped with said device and letting through the exhaust gases.

As illustrated in the different figures, the invention relates to an admission module intended to be placed on the cylinder head of an engine which includes for each cylinder a conduit 1 or a pair of conduits 1 intended to be extended in the cylinder head for supplying said cylinder with admission gas. This conduit 1 opens upwards into a free space 2 of the admission manifold 3. This manifold 3 has the shape of a box itself supplied with admission gas through a system not shown in the figure.

Figure 1:
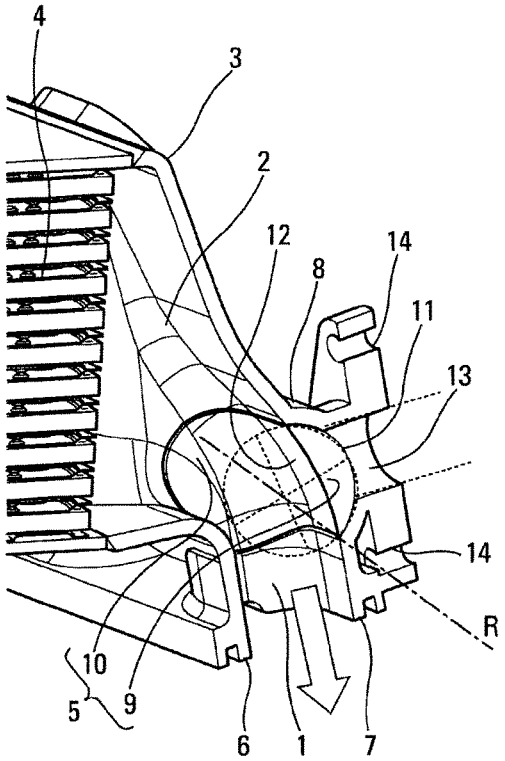

As the engine is a multi-cylinder engine, the first function of this manifold is to distribute the flows of admission gas among the conduits, such as the one illustrated in FIG. 1, dedicated to each cylinder. In the example shown, this manifold 3 integrates a heat exchanger 4 which is crossed by admission gases before they arrive in the free space 2, in communication with the supply conduits of the different cylinders. However, it is the task of the invention to adapt it to the conduit dedicated for supplying the cylinder regardless of the shape of the space of the manifold and regardless of what it integrates upstream from the mouth of this conduit.

The invention is more particularly directed to a device for controlling the flow of the admission gases and/or the re-circulated exhaust gases which may be integrated to this admission module.

Said flow control means includes here a rotary gate 5 installed on the conduit 1, at its mouth into the manifold 3, forming a controllable obturation system of said conduit. FIG. 1 shows this rotary gate 5 in a first position, leaving totally free the passage in the conduit 1 for the admission gas flow, represented by the arrow, towards the cylinder located below. The inner shape of the conduit 1 is here delimited by two substantially planar and parallel walls 6-7, connected to their ends through two curved walls.

Under these conditions, the gate 5 is cut out in a cylinder of axis R parallel to the two planar walls 6-7 and transverse to the conduit 1. This transverse cylinder has a diameter greater than the distance between both walls 6-7 and it is positioned so as to be tangent to the inner face of the wall 6 of the conduit 1 which connects with the bottom of the manifold 3. The opposite wall 7 is conformed with a boss 8 laid out so as to form a housing inside which the gate 5 included in the transverse cylinder may rotate while remaining in contact with the wall in the boss 8. This wall 7 connects to the side wall of the manifold 3.

The gate 5 in particular comprises a transverse portion 9, having substantially the same extension along the axis R as the planar walls 6-7, and occupying a portion of an angular sector of the transverse cylinder, as well as two circular cups, connected to the ends of the transverse portion 9. Said cups may form the walls of the conduit 1 between the planar walls 6-7, at the gate 5. Only one of these cups 10 is illustrated in FIG. 1. Also, the gate 5 advantageously includes a mechanism capable of having it rotate around the axis R of the transverse cylinder which is not illustrated in the figure. The cups 10 are not involved in the closing/opening function of the conduit 1 but they maintain the gate 5 in its housing during its rotations, by rotating in a portion of the walls of the conduit 1 forming a bearing.

Said gate, thereby conformed, ensures a flow control function, letting through the admission gas in a first position and blocking it in a second position. This operation is described hereafter.

In FIG. 1, the gate 5 is in a first position letting through the admission gases. It may be seen therein that the angular extension of the transverse portion 9 corresponds to the transverse cylinder portion crossing the inner planar face of the wall 7 connecting to the side wall of the manifold 3. The outer face 11 of the transverse portion 9 of the gate 5 follows the transverse cylinder so as to be able to rotate inside the housing formed by the boss 8 while remaining in contact with its inner wall. The internal surface 12 of the transverse wall 9 of the gate 5, as for it, substantially reproduces the inner planar surface of the wall 7 of the conduit 1, by shape continuity with the surrounding wall 7.

Figure 2:
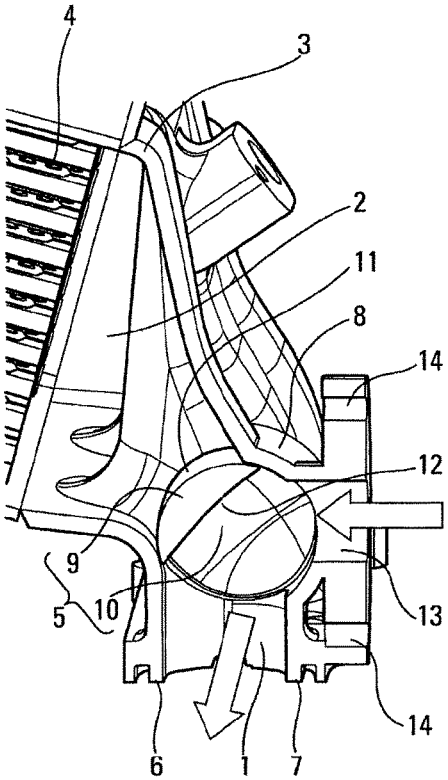

In FIG. 2, the gate 5 has been rotated around the axis R of the transverse cylinder so as to be found in a second position, where the transverse portion 9 blocks the section of the conduit 1 in front of the gate 5 relatively to the manifold 3. In order to obtain this result, the transverse cylinder should have a sufficient diameter, greater than the distance between the planar walls 6-7.

The diameter of the transverse cylinder in which is included the transverse portion 9, as well as the inner shape of the cups 10 are advantageously configured in order to have a gate 5 with a minimum size, which allows free passage of the admission gases in the section of the conduit 1 when the gate 5 is installed in its first position and which totally closes the section of the conduit 1 when the gate 5 is in its second position. The shape of the gate was briefly described here in the case of a conduit including two substantially parallel walls, of course it may be used with conduits of different section, for example a circular section.

The gate 5 shown here also fills the second part of the flow control function for feeding the cylinder of the engine, by allowing the arrival of the re-circulated exhaust gases when it is in the second position described earlier, and by blocking this passage when it is in the first position. How to obtain this result is described below.

In FIG. 1, it may be seen that an opening 13 is made here in the boss 8 of the wall 7 in which will be accommodated the transverse portion 9 of the gate 5. Further, this wall 7 is laid out around said opening 13, notably with an attachment flange 14, so that a second conduit, with a section corresponding to that of the opening 13 will connect to it. Preferentially, the end of this conduit is oriented substantially perpendicularly to the axis of rotation of the transverse cylinder in which is included the gate 5. Also preferably, the size of this opening 13 is smaller than the extension of the boss 8 on the wall 7 of the admission conduit 1 of the cylinder of the engine. Under these conditions, when the gate 5 is in its first position, as illustrated in FIG. 1, the transverse portion 9 obstructs the opening 13 and further its external face 11 is in contact with the inner wall of the boss 8 over a determined distance around this opening 13, which improves the seal. Generally, with these arrangements and taking into account geometrical constraints, the section of the opening 13 is smaller than that of the admission conduit 1. Finally, when the gate 5 is in its second position, as illustrated in FIG. 2, the opening 13 made in the boss 8 is completely clear.

According to the invention, the conduit which is connected to this opening 13 is supplied with exhaust gases recovered at the outlet of the engine. Therefore, with reference to what has just been discussed, when the gate 5 is in its first position, it blocks the introduction of exhaust gases into the conduit leading to the cylinder of the engine and when it is in its second position, it lets through the exhaust gas flow according to the arrows illustrated in FIG. 2. It may be moreover noticed that the shape of the inner wall 12 of the transverse portion of the gate is connected to the internal faces of the walls 6-7 of the conduit 1 facing the opening 13. Further, its tilt relatively to the planar walls continuously decreases in the direction downstream relatively to the direction of the gases. It therefore facilitates the passing of the exhaust gases by deflecting them into the direction of the conduit 1 after the bend formed by the device for these gases.

In this way, the gate 5 forms a flow control means giving the possibility of modulating the supply of the cylinder through the conduit 1 between two extreme situations, a supply with exclusively supply gases and a supply with exclusively re-circulated exhaust gases.

The integration of this gate on the supply module does not require modification of the general architecture thereof. Notably, the gate 5 put in the second position, in the closing mode of the conduit 1, is not invasive relatively to the empty space 2 in the manifold 3. It allows the admission gases to be freely distributed towards the other cylinder conduits of the engine, the mouth of which is not blocked. Further, as the opening 13 is made in the boss 8 of the gate 5, the whole may be integrated into the admission conduit 1 over the height available in the portion of the admission module intended to produce the interface with the cylinder head. Finally, the wall 7 in which is made the admission opening 13 for the recovered exhaust gases opens onto a face of the manifold 3 intended to be found above the cylinder head of the equipped engine. It is therefore easy for it to adapt a conduit in order to convey these exhaust gases.

However, it is difficult to make a device such as a gate 5 which obstructs in a completely leak-proof way the passages in front of which it is positioned. This is a little bothersome when the gate is put in position number two. Indeed, the pressure of the exhaust gases is generally greater than that of the admission gases. Therefore, there should not be the risk of having, towards the deactivated cylinder of the engine, any admission gas leak which may cause combustion. Further, the exhaust gas leaks towards the manifold 3 will be minimal since, by the geometry of the device, the higher pressure of the exhaust gases flattens the transverse portion 9 of the gate 5 against the walls 6-7 of the conduit 1. On the other hand, when the gate 5 is in its first position, i.e. during rated operation of the engine, the gate 5 may let through a certain exhaust gas leak flow which would modify the adjustments of the engine in a detrimental way to the yield.

Figure 3:
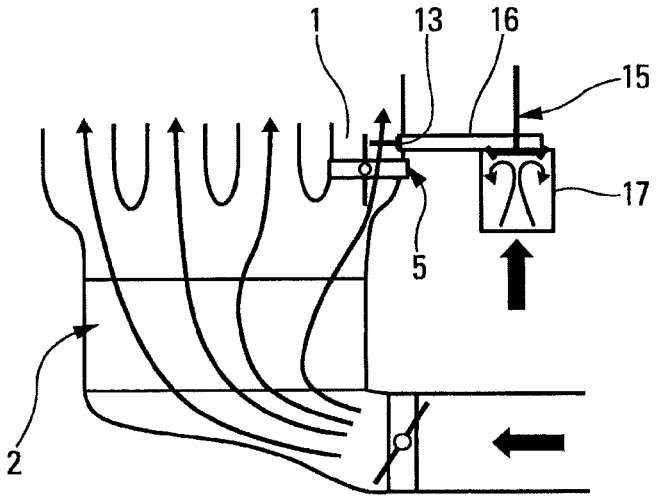
Figure 4:
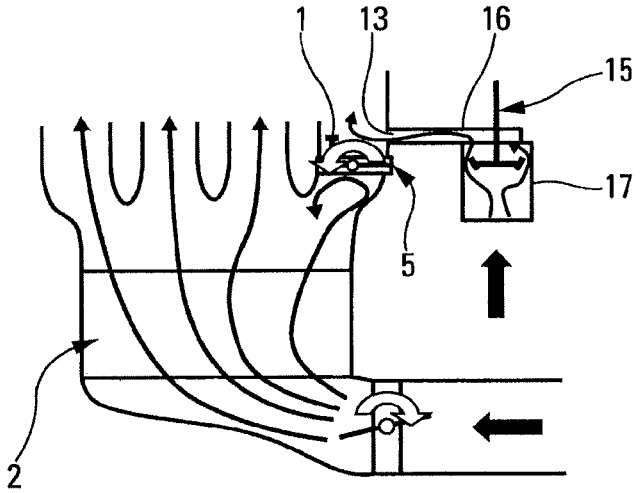

In order to overcome these possible drawbacks, with reference to FIGS. 3 and 4, a controllable valve is advantageously installed in front of the opening 13 bringing the exhaust gases in front of the gate 5, in order to be able to hermetically close this exhaust gas arrival. In an embodiment schematically shown in these figures, the valve controls the communication between the conduit 16 opening onto the opening 13 in the conduit 1 for supplying the cylinder and an arrival 17 of exhaust gases. Advantageously, this valve 15 is laid out so as to hermetically close the arrival of the exhaust gases when the gate 5 opens the conduit 1, and to open the communication with the exhaust gas manifold when the gate 5 closes the conduit 1. The valve 15 may be replaced with a flap or any other known means giving the possibility of hermetically closing the intake of the exhaust gases.

Figure 5:
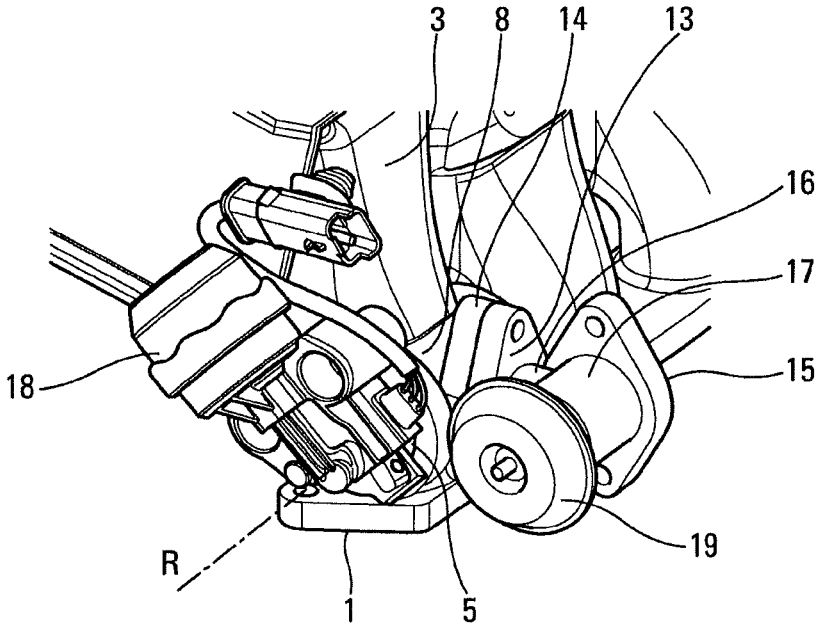
FIG. 5 shows a perspective view from the outside of the admission module shown as a sectional view in FIGS. 1 and 2.

The integration of the flow control means and of the valve on the admission module is illustrated in FIG. 5, as seen from the outside, for the embodiment of the device illustrated as a sectional view in FIGS. 1 and 2. A portion of the outer shape of the boss 8 is seen therein where the gate 5 is accommodated, at the inlet of the conduit 1, at the bottom of the admission manifold 3. Facing the attachment flange 14 on the opening 13 in the boss 8, the conduit 16 for intake of the exhaust gases is also seen therein. The inflow of these gases is controlled by a valve 15 which is located at the inlet of this conduit 16 in an intake body of the exhaust gases 17, having a wider inner space, recovering the exhaust gases at the outlet of the engine. The whole is grouped at the bottom of the manifold 3 but leaves the lower portion of the admission module clear which has to be connected to the cylinder head of the engine.

The device according to the invention may further comprise means for controlling the flow control means or the hermetic obturation means of the intake of the re-circulated exhaust gases. These control means may be installed in a compact way on the admission module. FIG. 5 schematically illustrates a first pneumatic means 18 for rotating the gate 5 and a second pneumatic means 19 for opening or closing the valve 15. In order to obtain the operating modes described earlier, these control means each receive commands from the control system of the engine, notably when the cylinder is deactivated or reactivated. Both of these control means are independent, which may have advantages in terms of modularity of the controls.

Figure 6:
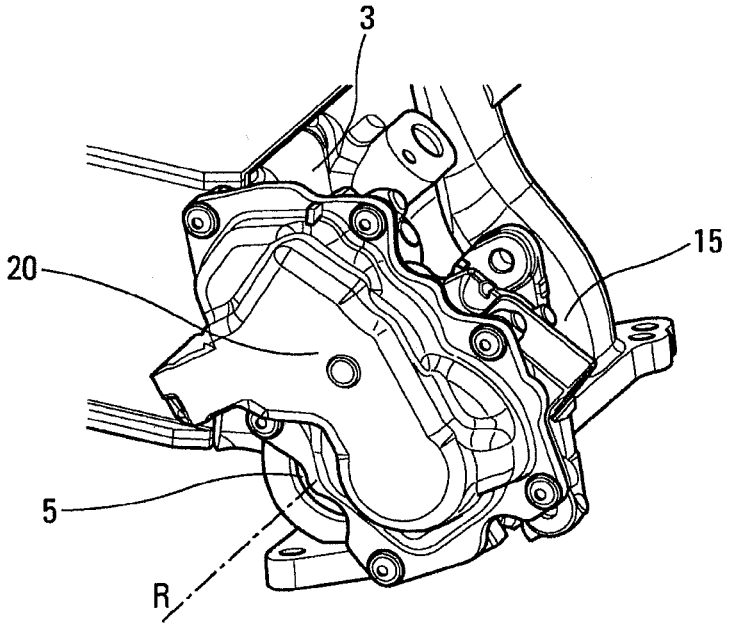
FIG. 6 shows an alternative of FIG. 5.

The preceding circuit is however complex and may have adjustment or reliability problems so as to make sure that the gate 5 and the valve 15 operate in a coordinated way from commands of the control system of the engine. In a second alternative, illustrated in FIG. 6, a single and same electric actuator 20 drives the mechanisms controlling the gate 5 and the valve 15. This device may provide more reliability. Notably, it controls in a coordinated way the gate and the valve from a single command of the control system of the engine.

The invention was described here for application on an air admission conduit for one cylinder of the engine. Of course it applies to the case when several cylinders of the engine are intended to be deactivated. In this case, each admission conduit of the relevant cylinders is equipped with the device which has been described. Preferably, each device has control means independent of each other. This layout gives the possibility of adapting the control of the gases entering the cylinder by controls for driving the engine determining the deactivation of a cylinder independently of the others.

Moreover, in an alternative embodiment not shown, said flow control means may comprise a first obturator, such as a first rotary flap, located in the portion of the conduit located upstream from the arrival of the re-circulated exhaust gases and a second obturator, such as a second rotary flap, located in the conduit portion corresponding to the arrival of the re-circulated exhaust gases.

The invention claimed is:

1. A device for introducing admission gases and/or re-circulated exhaust gases into a cylinder of an internal combustion engine, the device comprising:

a conduit configured for supplying said cylinder with admission gases and/or re-circulated exhaust gases, and a flow control means for independently controlling the flow of admission gases and/or re-circulated exhaust gases to a single cylinder of the internal combustion engine, said flow control means having a first position and a second position, wherein the first position supplies the cylinder with admission gases, and the second position supplies the cylinder with re-circulated exhaust gases.

2. The device according to claim 1, further comprising an opening in a wall of the conduit for intake of the re-circulated exhaust gases.

3. The device according to claim 2, wherein the flow control means comprises:

a rotatable gate inside the conduit, wherein said rotatable gate is rotatable around a transverse axis of the conduit and a transverse portion, wherein said transverse portion is configured to define said first and said second positions of said flow control means depending on the angular position of said gate.

4. The device according to claim 3, wherein the conduit comprises:

a boss configured for accommodating at least one fraction of the transverse portion of the rotatable gate when it is found in said first position, a device in which the opening for the arrival of the exhaust gases into said conduit is made in said boss, and an external face of the transverse portion of the rotatable gate that is configured for coming into contact with an internal wall of said boss around said opening for arrival of the exhaust gases when the gate is in said first position.

5. The device according to claim 3, wherein the transverse portion of the rotatable gate comprises an internal face, turned towards the inside of the conduit, and configured to form a portion of an internal surface of the wall of the conduit when the gate is in said first position.

6. The device according to claim 5, wherein the internal face of the transverse portion of the rotatable gate is configured for connecting to the internal surface of the wall surrounding the conduit with shape continuity when the gate is in said first position.

7. The device according to claim 3, wherein an internal face of the transverse portion of the gate is configured for forming a deflector of the exhaust gases when the gate is in said second position.

8. The device according to claim 1, wherein the flow control means is substantially placed at a first opening of the conduit opposite to a second opening intended for feeding the cylinder.

9. The device according to claim 1, wherein said device further comprises a controllable obturation means for the arrival of the exhaust gases that is adapted to hermetically close said arrival of the exhaust gases.

10. The device according to claim 9, wherein the hermetic obturation means for the arrival of the exhaust gases is a valve.

11. The device according to claim 9, wherein the means for controlling the flow control means in the conduit and the means for controlling the hermetic obturation means of the arrival of the re-circulated exhaust gases, are adapted to open said obturation means when said flow control means is in its second position and to close said obturation means when said flow control means passes into its first position.

12. The device according to claim 11, wherein the means for controlling the flow control means and the means for controlling the obturation means form a single actuator.

13. An air admission module of an internal combustion engine comprising at least one device according to claim 1.

14. An internal combustion engine comprising:

at least one cylinder, a system for deactivating said cylinder(s), and at least one device according to claim 1, wherein said device is configured for feeding said cylinder and being controlled by the deactivation system.

15. An internal combustion engine comprising:

at least two deactivatable cylinders, a system for deactivating at least two of said cylinders, and at least two devices according to claim 1, wherein each of said devices are configured for feeding one of said deactivatable cylinders and being controlled independently by said deactivation system.

16. The device according to claim 1, wherein the first position completely blocks exhaust gases from the cylinder.

17. The device according to claim 1, wherein the second position completely blocks admission gases from the cylinder.

18. The device according to claim 1, wherein the first position exclusively supplies admission gases to the cylinder.

19. The device according to claim 1, wherein the second position exclusively supplies exhaust gases to the cylinder.

20. The device according to claim 9, wherein the first position exclusively supplies admission gases to the cylinder and completely blocks exhaust gases from the cylinder, and the second position exclusively supplies exhaust gases to the cylinder and completely blocks admission gases from the cylinder.

* * * * *